United States Patent [19]

Metz

[11] Patent Number: 4,740,766

[45] Date of Patent: Apr. 26, 1988

[54] PRECISION TRACKING CURRENT GENERATOR

[75] Inventor: Arthur J. Metz, Gervais, Oreg.

[73] Assignee: Tektronix, Inc., Beaverton, Oreg.

[21] Appl. No.: 92,906

[22] Filed: Sep. 4, 1987

[51] Int. Cl.[4] ..... G05F 3/22

[52] U.S. Cl. ..... 323/316; 323/267

[58] Field of Search ..... 323/312, 313, 314, 315, 323/316, 267, 271, 272; 330/257, 288, 297

[56] References Cited

U.S. PATENT DOCUMENTS

| | | | |
|---|---|---|---|
| 4,251,743 | 2/1981 | Hareyama | 323/316 X |
| 4,283,673 | 8/1981 | Lieux | 323/316 |
| 4,399,399 | 8/1983 | Joseph | 323/316 X |
| 4,628,249 | 12/1986 | Ikefuji et al. | 323/316 X |

*Primary Examiner*—Peter S. Wong
*Attorney, Agent, or Firm*—George T. Noe

[57] ABSTRACT

A precision current generator provides an output current responsive to a reference supply voltage. The current generator comprises a voltage generator which drives the input to a buffer amplifier. The buffer amplifier output drives the bases of multiple output transistors, the collectors of which form the current outputs. The output current is not dependent upon transistor beta, junction voltage, temperature or supply voltage. The all NPN design enables the current generator to track the reference voltage at high frequencies without peaking or ringing of the output current and without voltage coupling between output devices.

10 Claims, 2 Drawing Sheets

PRECISION TRACKING CURRENT GENERATOR

BACKGROUND OF THE INVENTION

The present invention relates generally to current generators, and more particularly to a precision tracking generator for use in integrated circuits.

Current generators, such as current sources and current sinks, are widely used in integrated circuits (IC's) to provide operating currents and reference currents where appropriate. It is fairly common to apply both positive and negative supply voltages to the IC device, and to reference the substrate of the device to a negative supply voltage. In such devices, it is often desirable to establish a precision stable current source or sink from the negative power supply, but responsive to a reference voltage.

Prior art current generator designs are legion. Several designs include simple two and three transistor circuits. These circuits, while easy to implement, lack precision performance. Such designs are susceptible to variations in transistor beta, transistor junction voltage, temperature and power supply voltage. More complicated current generator designs involving PNP transistors, usually in a feedback loop, provide an improvement in performance but are limited to low frequency operation. Furthermore, these designs are inherently unstable if lateral PNP transistors are used. Undesirable peaking and ringing in the output current can occur due to a sudden change of the reference voltage. An additional problem found in current generator designs with multiple current outputs is that of coupling between output devices. A change in the load on one of the output devices may modulate the current output of the other output devices.

What is desired is a precision tracking current generator which is easy to implement, is insensitive to variations in transistor beta, transistor junction voltage, temperature and power supply voltage, tracks changes in the reference voltage at high frequencies without peaking or ringing in the output current, and, in a multiple output configuration, minimizes coupling between output devices.

SUMMARY OF THE INVENTION

In accordance with the present invention, a current generator provides an output current responsive to a reference voltage. The current generator includes a voltage generator which provides a control voltage which is the sum of the negative supply voltage, a voltage proportional to the reference voltage and an offset voltage. The control voltage is provided to the input of a buffer amplifier which, in a preferred embodiment, is simply an NPN transistor in an emitter follower configuration. The output voltage of the buffer amplifier is provided to the bases of parallel current output transistors. Each output transistor is appropriately scaled and includes a current setting emitter resistor which is connected to the negative supply voltage. The collector currents of each output transistor form the output currents. The voltage offsets created by the junction voltages of the buffer transistor and the output transistors is precisely compensated by the offset voltage in the voltage generator. Consequently, a voltage proportional to the reference voltage is impressed directly across each current setting emitter resistor.

Thus, currents are generated which are linearly responsive to a reference voltage. These output currents are not sensitive to variations in transistor beta, junction voltage, temperature or supply voltage. Furthermore, the output current remains linearly responsive to the reference voltage at high frequencies without undesirable peaking or ringing. Due to the low impedance output of the buffer amplifier, coupling between output devices is minimized.

DESCRIPTION OF THE PREFERRED EMBODIMENT

Figure 1:
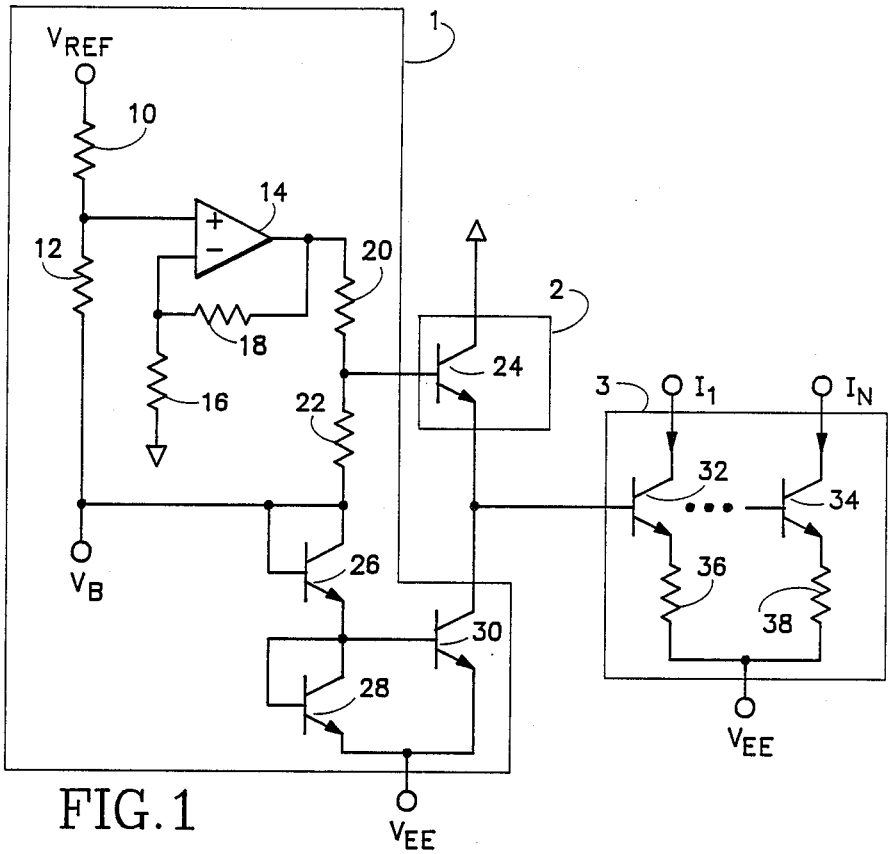
FIG. 1 is a schematic diagram of a current generator according to the present invention.

The operation of the current generator is discernable upon an analysis of FIG. 1. The circuit is divided into three basic sections: a voltage generator, a buffer amplifier and one or more current output devices.

The voltage generator includes resistors 10 and 12, which form an input voltage divider circuit, operational amplifier 14, gain setting resistors 16 and 18, resistors 20 and 22, which form an output voltage divider circuit and diode connected transistors 26 and 28, which provide an offset voltage. Also shown in FIG. 1 and included in the voltage generator are voltages $V_{REF}$ and $V_B$. The reference voltage $V_{REF}$ is an input voltage source which is connected to the input voltage divider circuit. The voltage $V_B$ is the voltage found at the junction between resistors 12 and 22 and transistor 26 and which is also equal to the supply voltage $V_{EE}$ plus two junction voltage drops. It is not a voltage source and is labeled only for convenience of analysis. If resistors 12 and 18 each have a value of $R_1$ and resistors 10 and 16 each have a value of $R_2$ it can be shown that the voltage at the output of the operational amplifier 14 is:

$$V_{OUT}=(R_1/R_2)*V_{REF}+V_B$$

Thus, the voltage at the output of the operational amplifier 14 is equal to a voltage which is the sum of the voltage $V_B$ plus a voltage which is proportional to the reference voltage.

This voltage also appears at one end of the output voltage divider circuit. The other end of the output voltage divider has a voltage which is simply $V_B$. The voltage appearing across the output voltage divider circuit is then given by the term $(R_1/R_2)*V_{REF}$. This voltage is not a function of the supply voltage $V_{EE}$ or the voltage $V_B$. The output voltage divider circuit is used to linearly scale this voltage before it appears at the base of transistor 24.

In the preferred embodiment, the transistor 24 forms the buffer amplifier. The transistor 24 is in an emitter follower configuration. The base of transistor 24 is a high impedance which will not load the voltage delivered by the output voltage divider circuit. The emitter of transistor 24 impresses the voltage from the output voltage divider circuit, minus one junction voltage drop, across the bases of the parallel output devices 32 through 34. The bases of the output devices 32 through 34 is designated as the base reference line. The emitter of transistor 24 provides the current gain necessary to drive the bases of multiple output devices, as well as maintaining a low impedance at the base reference line. The current output capability of transistor 24 is necessary for supplying the base current of the output devices. The low impedance is desirable since it prevents coupling between output devices. That is, the capacitance of the collector to base junction of the output devices 32 through 34 enables voltage variations at the collector of any one output device to appear at the base reference line. If the impedance at the base reference line is high, the corresponding voltage variation also is high and results in unwanted modulation of all the current outputs. If the impedance of the base reference line is low, the corresponding voltage variation is low and all the current outputs remain constant.

The final portion of the circuit is the output current stage which includes transistors 32 and 34 as well as current setting resistors 36 and 38. One or more ouput transistors may be used. The voltage appearing across the current setting resistors 36 and 38 determines the ouput current. If the voltage across these resistors is linear, the ouput current is linear. The voltage across the output voltage divider circuit is linear, but two junction voltage drops appear between this linear voltage and the gain setting resistors. One of the junction voltage drops is due to the emitter base junction voltage of buffer transistor 24, the other is due to the emitter base junction of one of the output transistors 32 or 34. The present invention has an offset correction circuit. This circuit includes diode connected transistors 26 and 28 and transistor 30. This circuit provides a precise offset voltage equal to the offset voltage produced by transistors 24 and 32 or 34, which is then added to the linear voltage found at the base of transistor 24. Thus, after the two junction voltage drops a linear voltage appears across the current setting resistors 36 and 38. In order for the offset correction circuit to achieve maximum precision, two design constraints are followed. First, the current density through transistor 26 matches the current density through the output transistors. This may be achieved through careful selection of device sizes as well as the values of the resistors 20 and 22 in the output voltage divider circuit. Secondly, the current density through transistor 28 matches the current density through transistor 24. This may be achieved through careful selection of the device size transistors 28 and 30, which form a simple current mirror, and transistor 24.

It has been established that a precise linear voltage proportional to a reference voltage may be generated and impressed across a current setting resistor of an output current transistor to form a linear output current. It has also been established that this current is not a function of transistor junction voltage drops or supply voltage. A more detailed description and analysis of the present invention shows how the output current tracks the reference voltage at high frequencies.

Figure 2:
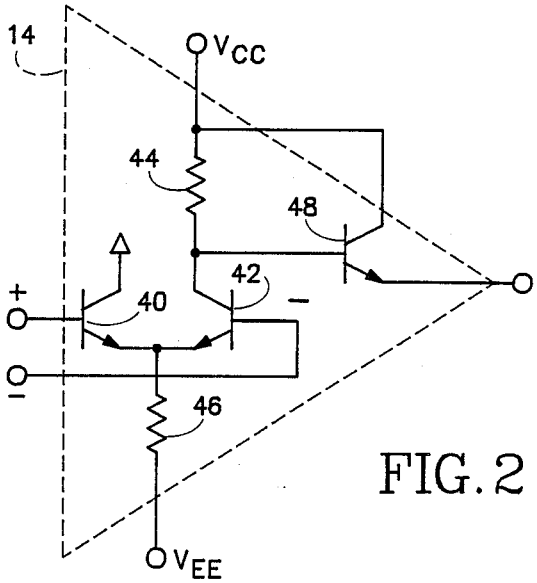
FIG. 2 is a schematic diagram of the operational amplifier shown in the schematic diagram of FIG. 1.

An implementation of the operational amplifier 14 is shown in FIG. 2. The design of the operational amplifier uses a three NPN transistor design. Transistors 40 and 42 form an input transistor pair. Bias current is provided by emitter resistor 46. The output voltage is developed across load resistor 44 and is buffered by transistor 48. This circuit is capable of extremely high frequency operation if constructed with vertical NPN integrated transistors. The small number of transistors adds little parasitic capacitance and enable the circuit to be easily fabricated. Because of the all NPN design, the circuit is also inherently stable.

Figure 3:
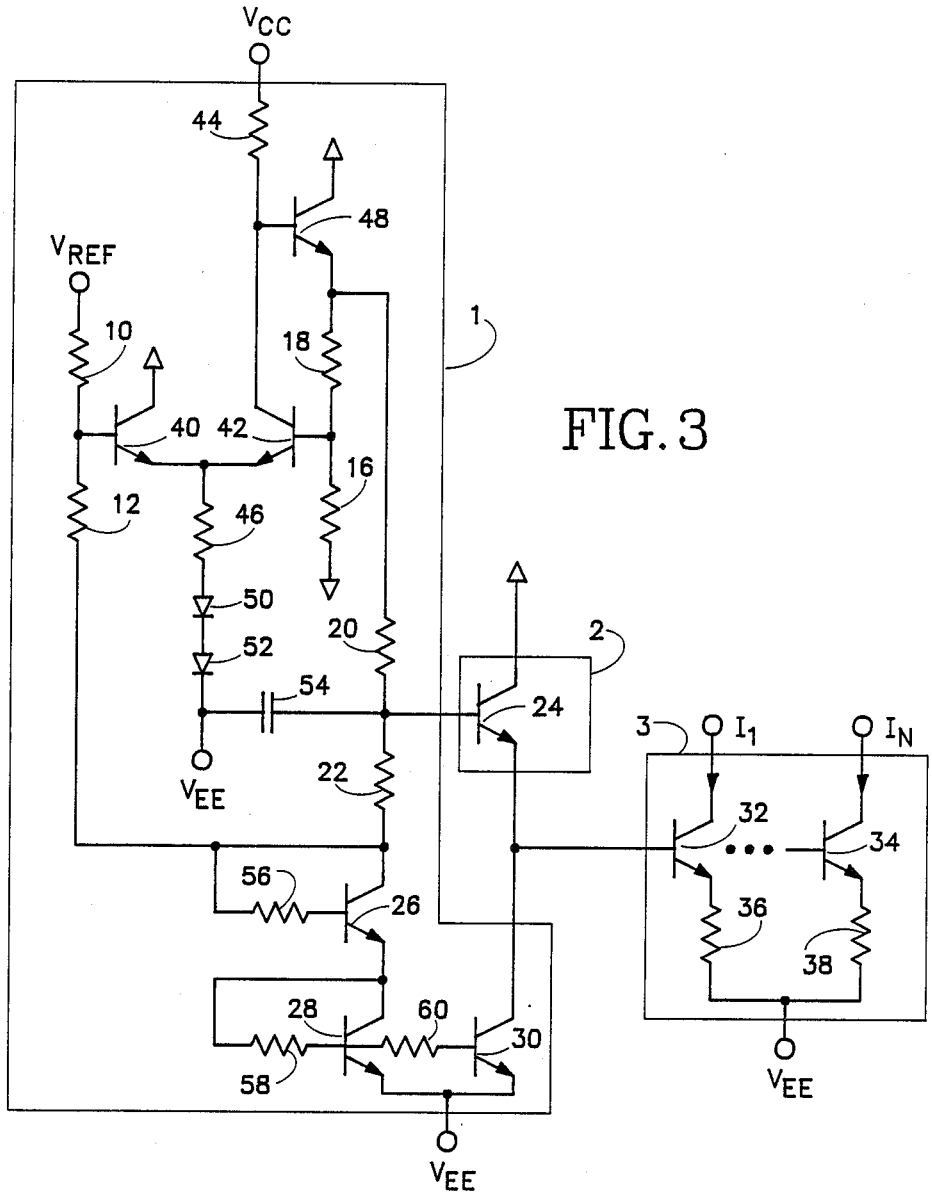
FIG. 3 is a detailed schematic diagram of the current generator according to the present invention.

The final implementation of the preferred embodiment, including the operational amplifier design, as well as other enhancements is shown in FIG. 3.

Diodes 50 and 52 are included in the final design of the operational amplifier to maintain a relatively constant bias current through transistors 40 and 42. Specifically, these diodes are added to compensate for the changes in $V_B$ and the base emitter voltages of transistors 40, 42 and 48. The exact number of diodes needed may be different than two depending on the final choice of resistor ratios and power supply voltages. Capacitor 54 is added to reduce the output impedance of transistor 24 at high frequencies. Resistor 60, at the base of transistor 30, decreases the output current of transistor 30 to compensate for the additional current generated by the base currents of the output transistors. This compensation is necessary to maintain proper current density in transistor 24. Resistor 58 at the base of transistor 28, is necessary to slightly increase the offset voltage produced by transistor 28. In doing so, the voltage at the base of transistor 24 is slightly increased and therefore the voltage across the current setting resistors 36 and 38 is slightly increased. This extra voltage is necessary to compensate for the alpha current loss of the output current transistors. That is, a portion of the current set in the emitters of output transistors 32 and 34 is lost due to base current. An additional common base stage at the present current output may be added to improve high voltage performance of the current generator, but at the price of additional base current losses. An additional resistor 56 at the base of transistor 26 may be included for a further slight increase in current if this cascode arrangement is used.

The value of the resistors 56, 58 and 60 may be easily calculated. It can be shown that the value of resistors 56 and 58 should both be substantially equal to the value of resistor 22. In the case of resistor 60, the value is approximately equal to the ratio of the total output current to the collector current of transistor 30 divided by the transconductance of transistor 30.

An additional feature of the final implementation of the current generator is that of power reduction. Wherever possible, transistor collectors are returned to ground rather than the positive power supply $V_{CC}$. This has been done in the collectors of transistors 40, 48 and 24.

Thus, it has been shown that the preferred embodiment of the invention produces an output current which tracks a reference voltage. This voltage is not a function of transistor beta, junction voltage, temperature or supply voltage. The tracking is possible at high frequencies without peaking or ringing in the output current. The output transistors are isolated from one another in that changes in the voltage of one of the output transistor collectors does not produce a corresponding modulation in the remaining output currents.

While the invention has been particularly shown and described with reference to certain preferred embodiments, it will be understood by those possessing ordinary skill in the art that various changes in form and detail may be made without departing from the spirit and scope of the invention.

I claim:

1. A current generator comprising:

a. an output device for developing an output current therethrough, said output device having a characteristic threshold voltage and being coupled to a source of supply voltage;

b. a voltage generator coupled to said supply voltage source and to a source of reference voltage for producing a control voltage, said control voltage being substantially equal to a voltage which is the sum of said supply voltage, said threshold voltage and a voltage proportional to said reference voltage; and c. a buffer amplifier having a high input impedance and a low output impedance interposed between said voltage generator and said output device such that said output current tracks changes in said reference voltage.

2. A current generator as in claim 1 wherein the output device comprises a transistor having a base, a collector and an emitter.

3. A current generator as in claim 2 wherein the output device further comprises a current setting resistor interposed between the emitter of said transistor and said supply voltage source.

4. A current generator as in claim 1 wherein the buffer amplifier has an offset voltage between the input and output thereof.

5. A current generator as in claim 4 wherein the control voltage further comprises a voltage substantially equal to said buffer amplifier offset voltage.

6. A current generator as in claim 1 wherein the buffer amplifier comprises a transistor.

7. A current generator as in claim 1 wherein the buffer amplifier comprises an operational amplifier.

8. A current generator as in claim 1 wherein the voltage generator comprises an input voltage divider coupled to said reference voltage source, an output voltage divider coupled to said buffer amplifier and an operational amplifier interposed therebetween.

9. A current generator as in claim 8 wherein the operational amplifier further comprises a first and second transistor, each having an emitter, a collector and a base, said first and second transistor being emitter coupled, and a third transistor having an emitter, a collector and a base, said base of said third transistor being coupled to said collector of said second transistor and said emitter of said third transistor forming the output, said bases of said first and second transistors forming the positive and negative inputs.

10. An operational amplifier as in claim 9 further comprising a diode coupled between said emitters of said first and second transistors and a resistor which is coupled to the supply voltage source for temperature stabilizing the current flowing through said first and second transistors.

* * * * *